US005348383A

United States Patent [19]

Ritt

[11] Patent Number: 5,348,383

[45] Date of Patent: Sep. 20, 1994

[54] TWO WAY OPENING DISPLAY CASE

[76] Inventor: K. Thomas Ritt, P.O. Box 430, Sunland Park, N. Mex. 88063

[21] Appl. No.: 969,118

[22] Filed: Oct. 30, 1992

[51] Int. Cl.[5] ..... A47F 3/00; E06B 11/00

[52] U.S. Cl. ..... 312/138.1; 49/192

[58] Field of Search ..... 312/114, 138.1, 140; 49/192

[56] References Cited

U.S. PATENT DOCUMENTS

| | | | |
|---|---|---|---|
| 926,298 | 6/1909 | Simon | 312/139 X |
| 1,018,679 | 2/1912 | Omwake | 312/139 |
| 1,844,332 | 2/1932 | Newman | 312/138.1 |
| 2,264,419 | 12/1941 | Unger et al. | 312/138.1 X |
| 3,667,162 | 6/1972 | Lalagüe | 49/192 |
| 3,690,035 | 9/1972 | Schindlauer | 49/192 |
| 3,911,621 | 10/1975 | McHeffey | 49/192 |
| 4,602,457 | 7/1986 | Kreusel | 49/192 |
| 4,679,352 | 7/1987 | Bates | 49/192 |

*Primary Examiner*—Kenneth J. Dorner
*Assistant Examiner*—N. Mulcare

[57] ABSTRACT

A display case with a lid or door being capable of opening in two directions about an axes perpendicular to each opening direction. The lid or door is attached to a subframe with a pivotal means, such as a hinge, and the subframe is attached to a main frame with a pivotal means perpendicular to the pivotal means attached between the lid and the subframe. The lid or door can be opened in one direction by pivoting the pivotal means attached between the lid and subframe or can be opened the position perpendicular to that by pivoting the pivotal means between the subframe and main frame, thus pivoting the lid and subframe together.

7 Claims, 2 Drawing Sheets

TWO WAY OPENING DISPLAY CASE

BACKGROUND—FIELD OF INVENTION

This invention relates to a two-way opening display case. The principal object of the invention is to providea display case with an opening surface that can be opened from two different sides perpendicular to each other. The two way opening feature for this invention would allow the user of a top opening, rectangular shaped display case on a rectangular surface (such as a table) to either place it parallel or perpendicular to a table shape and still be able to open it from the rear as defined by the user.

BACKGROUND—DESCRIPTION OF PRIOR ART

Display cases of various sizes, shapes, and configurations are readily available. However, they are relatively inflexible in that they are only provided with opening capabilities in one direction. Attempting to use a display case in different situations will quite often find short comings because of space availability, products to be displayed, etc. The important feature of my invention resides in its flexibility to its user. It is of particular benefit to portable display cases with top opening lids that are used under different conditions at different times. Heretofore a rectangular portable display case with opening lid had to be purchased with either the long or short end hinged. This allows the display case to be used in only one direction and one configuration. However, invention allows the purchaser to use the same display case in either configuration in that it will open from either the short or the long side of a rectangular shaped display case.

The "Two Way Opening Display Case" could be manufactured from either non-ferrous metal such as aluminum or ferrous metal such as steel, petroleum by-products such as plastic or wood or wood by-products. It would normally have part or all of one side or surface translucent using material such as glass or translucent plastic. This would allow the items placed in the display case for display to be seen when the opening surface is in the closed position. A typical embodiment of the invention would be to make a rectangular display case using aluminum for the main frame sides, chipboard bottom, an aluminum and glass lid and an aluminum subframe with a steel hinge attached between the lid and the subframe. A second steel hinge would be attached between the subframe and main frame perpendicular to the first hinge.

There are a number of inventions that have multiple axes opening doors or windows that might be applied to display cases. However, they are either complex and expensive to manufacture or they require the inconvenient engaging and disengaging of pins to attain the multiple axes features.

U.S. Pat. No. 4,532,673 to Kim (1985) discloses a complex system of actuator rods and cylindrical bosses. This system would be cumbersome and expensive to manufacture. U.S. Pat. No. 3,654,663 to Algotsson (1972) discloses cut-outs and corresponding lugs into which pins are inserted to provide the desired hinge mechanism. U.S. Pat. No. 3,690,035 to Schindauer (1972) discloses a system of electrically operated pins that engages with a sleeve to form a hinge that will provide the pivoting mechanism.

Thus, the prior art, while suggesting a variety of mechanisms for achieving selective axes opening pivotal windows and doors, has failed to suggest a simple inexpensive mechanism for achieving a selective opening pivotal movement for a display case. My invention will eliminate the need for the user to purchase two portable displays for use under different conditions. This would benefit the user by a savings of money. An added benefit would be less space required to store and transport one unit instead of two.

SUMMARY OF THE PRESENT INVENTION

In accordance with the present invention, an opening pivot mechanism is provided for a display case, window, door or any type of closure that permits the closure to be opened easily in two directions.

There are three main components to this invention, the main frame, the subframe, and the lid. The principal component that makes this invention unique is the subframe. It is attached to one side of the main frame by a hinge or other pivotal means. The lid is attached to the subframe by another hinge or pivotal means perpendicular to the first hinge. This will allow the lid to open in one direction by both the lid and subframe being lifted together pivoting the hinge that attaches the subframe to the main frame. The can also be opened perpendicular to the first opening position by lifting the lid so the hinge that attaches the lid to the subframe pivots and the subframe stays stationary with the main frame.

Although the description above contains many specifications, these should not be construed as limiting the scope of the invention, but as merely providing illustrations of some of the presently preferred embodiments of the invention. For example, the Two Way Opening Display Case can have other shapes, such as circular, oval, trapezoid, triangular, etc. Thus the scope of the invention should be determined by the appended claims and their legal equivalents, rather than by the examples given.

DRAWING FIGURES

Reference Numerals In Drawings

Figure 1:
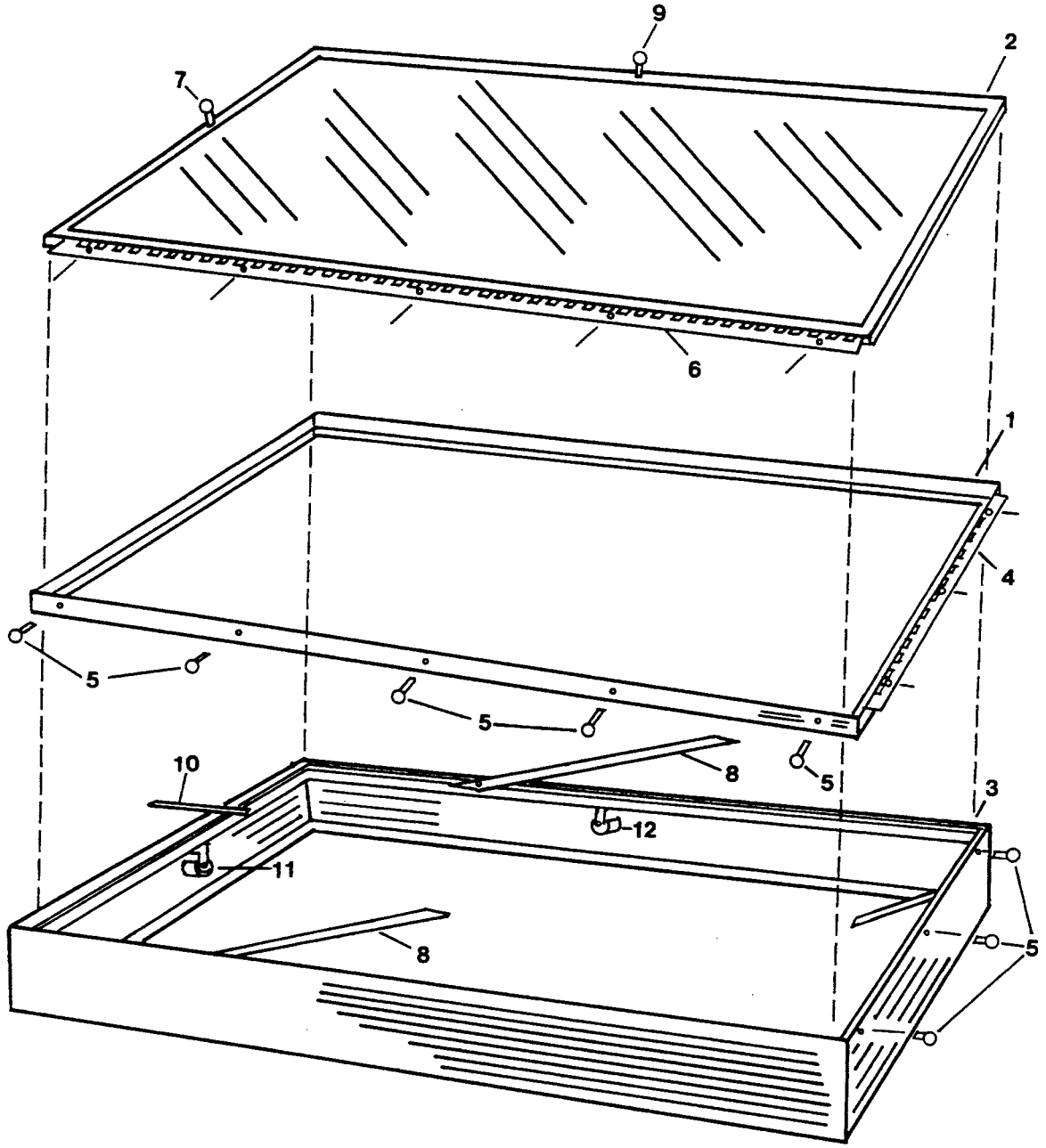
FIG. 1 is an expanded assembly view of the Two Way Display Case showing the three major components of the invention; the lid, the subframe, and the main frame.

1 Subframe
2 Lid
3 Main frame
4 Short hinge
5 Rivets
6 Long hinge
7 Finger grip (short side)
8 Prop arms for short side
9 Finger grip (long side)
10 Prop arms for long side
11 Lock (short side )
12 Lock (long side)

DETAILED DESCRIPTION OF DRAWINGS

Figure 2:
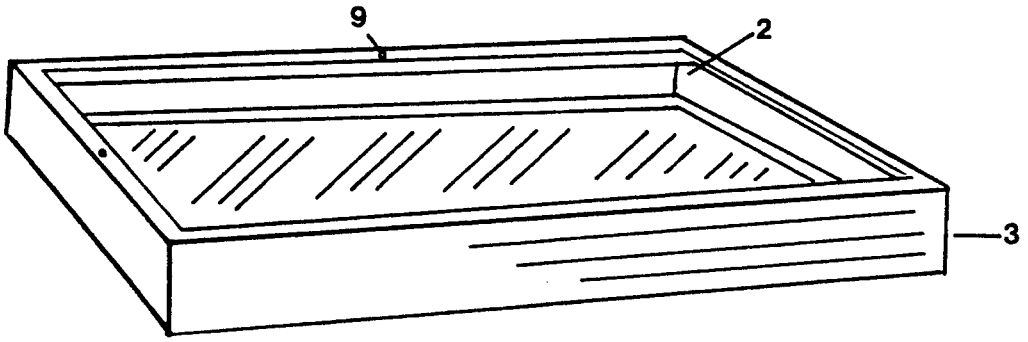
FIG. 2 is a prospective view of the Two Way Opening Disk, lay Case shown with the lid in the closed position.
Figure 3:
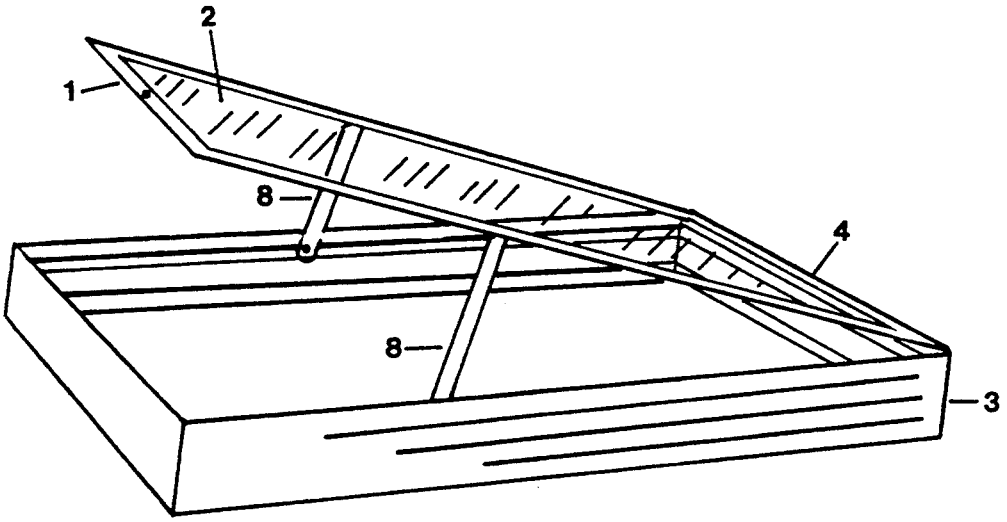
FIG. 3 is a prospective view of the Two Way Opening Display Case shown with the lid open at the short side.
Figure 4:
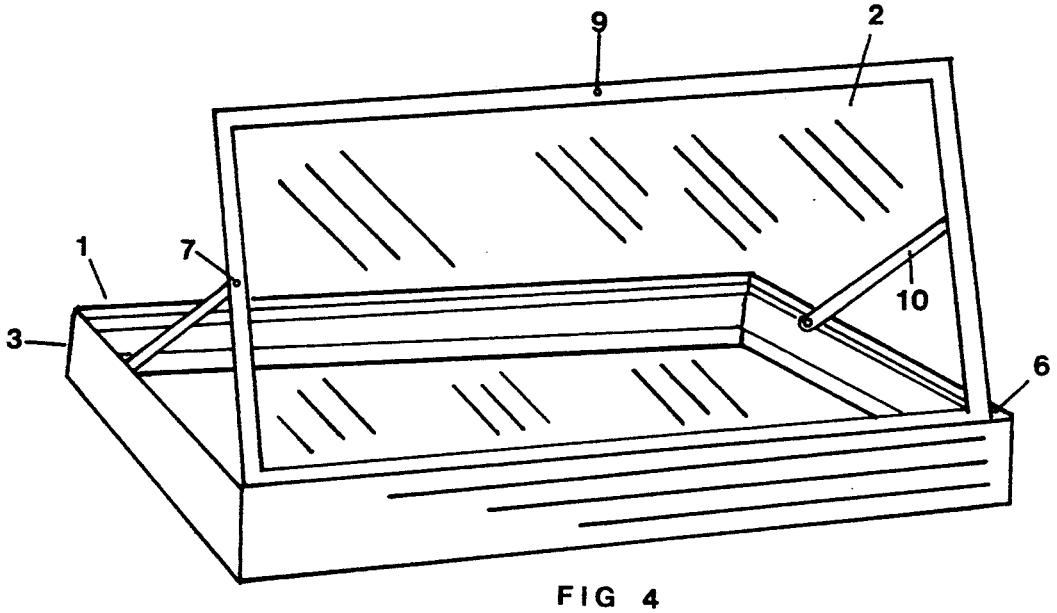
FIG. 4 is a prospective view of the Two Way Opening Display Case shown with the lid open at the long side.

A typical embodiment of the features of the present invention is illustrated in FIG. 1, an expanded assembly view. The subframe 1 is attached between the lid 2 and the main frame 3. The subframe 1 is attached to the lid 2 by a long hinge 6 using rivets 5. The subframe 1 and main frame 3 are attached by the short hinge 4 using rivets 5. The uniqueness of the construction allows the lid 2 to be opened in either of two different directions. The short end from the closed position FIG. 2 to the open position FIG. 3 by lifting the lid 2 and subframe 1 together using finger grip 7 and pivoting hinge 4 on the opposite side attached to the subframe 1 and the main frame 3. The lid 2 can be propped open by the use of prop arms 8 that are attached to the main frame 3 and pivot up when in use as in FIG. 3 and down when not is use as in FIG. 2. The lid 2 can also be opened from the long side FIG. 4 by using finger grip 9 that is attached to the lid 2 lifting the lid 2 pivoting the hinge 6 attached to the subframe 1. The lid 2 can be propped open by using props 10 that are attached to the main frame 3 and pivot up when in use as in FIG. 4 and down when not in use as in FIG. 2. The Two Way Opening Display Case can also be left and used in the closed position FIG. 2 and locked by the lock on the short side 11 or by the lock on the long side 12.

Although the description above contains many specifications, these should not be construed as limiting, the scope of the invention but as merely providing illustrations of some of the presently preferred embodiments of this invention. For example, this invention can have other shapes such as circular, oval, trapezoid, triangular, etc. Thus the scope of the invention should be determined by the appended claims and their legal equivalents, rather than by the examples given.

I claim:

1. A two way opening display case which includes;

a main frame, consisting of a planar bottom and a plurality of walls, each having an inner side facing the inside of the frame and an outer side facing the outside of the frame and each wall extending upwardly from said bottom wherein the inner sides of the walls define and inner perimeter and wherein an opening is defined at the top of the main frame sides, a subframe having an opening in the top is fittedly positioned inside the main frame wherein the subframe has subframe walls which are correspondingly sized and shaped to permit the subframe to fit inside and adjacent the inner perimeter of the main frame along the inner side of each of the main frame walls a lid, wherein the first hinge means is positioned along a wall of the main frame and connected thereto and is also connected to a first edge of the lid such that the lid may pivot along the axis of the hinge on its first edge, and wherein the second hinge means is positioned along a subframe wall of the subframe and connected thereto and is also connected to an adjacent second edge of the lid wherein the first edge and second edge are perpendicular to one another, such that the lid may pivot along the axis of the second hinge on its second edge.

2. The display case defined in claim 1 made of non-ferrous metal such as aluminum.

3. The display case defined in claim 1 made of ferrous metal such as steel.

4. The display case defined in claim 1 made of petroleum by-products such as plastic.

5. The display case defined in claim 1 made of wood or wood by-products.

6. The display case defined in claim 1 with said main frame walls made of non-ferrous metal such as aluminum, and the bottom made of a wood by-product such as chipboard and the said lid made from non-ferrous metal such as aluminum and a translucent material such as glass or plastic.

7. The display cabinet of claim 1 wherein there are four main frame walls and four subframe walls and four external edges on the lid and wherein the walls of each of the main frame and subframe from a rectangular storage area.

* * * * *